US005308067A

United States Patent [19]

Cook

[11] Patent Number: 5,308,067

[45] Date of Patent: May 3, 1994

[54] PUTTER HEAD

[76] Inventor: Raymon W. Cook, 13615 Pebble Way, San Antonio, Tex. 78231

[21] Appl. No.: 2,598

[22] Filed: Jan. 11, 1993

[51] Int. Cl.[5] ..... A63B 53/04

[52] U.S. Cl. ..... 273/164.1; 273/78; 273/167 F; 273/169

[58] Field of Search ..... 273/167 R, 77 A, 164.1, 273/193 R, 194 R, 162 R, 79

[56] References Cited

U.S. PATENT DOCUMENTS

| | | | |
|---|---|---|---|
| D. 222,280 | 10/1971 | Cook . | |
| D. 222,752 | 12/1971 | Cook . | |
| D. 235,568 | 6/1975 | Cook | 273/78 X |
| D. 236,517 | 8/1975 | Cook . | |
| D. 238,087 | 12/1975 | Cook . | |
| D. 238,285 | 12/1975 | Ross | 273/78 X |
| 3,042,405 | 7/1962 | Solheim | 273/78 |
| 3,061,310 | 10/1962 | Giza | 273/78 |
| 3,516,674 | 6/1970 | Scarborough | 273/169 |
| 3,578,332 | 9/1967 | Caldwell | 273/78 X |
| 3,841,640 | 10/1974 | Gaulocher | 273/164.2 |
| 3,884,468 | 5/1975 | Cook . | |
| 3,923,308 | 12/1975 | Mills | 273/78 X |
| 3,931,975 | 1/1976 | Cook . | |
| 3,954,270 | 5/1976 | Cook . | |
| 4,113,249 | 9/1978 | Beery . | |
| 4,121,832 | 10/1978 | Ebbing | 273/171 |
| 4,655,459 | 4/1987 | Antonious | 273/167 H X |
| 4,693,478 | 9/1987 | Long | 273/164.1 |
| 4,756,535 | 7/1988 | Bradley | 273/78 X |
| 4,834,387 | 5/1989 | Waites et al. | 273/167 H X |
| 4,979,744 | 12/1990 | Alcala | 273/169 |

OTHER PUBLICATIONS

Manual of Steel Construction, Eighth Edition, by American Institute of Steel Construction, Inc, Copyright 1980, pp. (6–8) and (6–9).

Advertisement of HMI II putter by Slotline Golf, 1992.

*Primary Examiner*—Vincent Millin
*Assistant Examiner*—Sebastiano Passaniti
*Attorney, Agent, or Firm*—Gunn, Lee & Miller

[57] ABSTRACT

A putter head (10) comprised of a frame or bracket housing (12), two end bodies (14*a*) and (14*b*), and a face (18) having uniform thickness. The two equally dimensioned end bodies (14*a*) and (14*b*) are mounted adjacent or outboard of the frame or bracket housing (12). The tabular face (18) is mounted to the end blocks (14*a*) and (14*b*). The putter head face (18) is provided with a 0° to +10° loft.

16 Claims, 6 Drawing Sheets

PUTTER HEAD

FIELD OF THE INVENTION

The subject of the invention relates to golf clubs and more particularly a putter head.

BACKGROUND

Those who have played the game of golf are well aware that putting often accounts for nearly half the golfer's total score. Although there are a wide variety of putters available to the golfers, they still seek improved designs that will assist them in lowering their total score.

Golf putter heads have been designed to impart a rolling motion to the golf ball for short distances. The putter is specifically constructed for use in striking the golf ball accurately toward the cup once it has reached the putting green. Typically, the general construction of a golf club includes a grip portion adapted to be grasped by the golfer, a shaft extending linearly downward from the grip portion, to a club head at the end of the shaft opposite the grip portion. Typically, the club head extends traversely to the shaft and the shaft has a neck portion located at one end thereof, which is connected by a hosel to the shaft.

The golfer addresses the golf ball by placing the club adjacent to the ball. The golfer then swings the club in a short, sweeping arc for a desired, but seldom achieved, perfect swing.

Such a perfect swing would include contacting the "sweet spot" of the putter face. The sweet spot is the spot on the putter face about which there is zero torque. Striking the golf ball at a point off the sweet spot may open or close the face of the club and cause the ball to travel off line. Putter heads are designed to reduce the torque imparted to the putter head when striking the ball off the sweet spot. The feel of the putter as it strikes the golf ball is an important design feature. A putter with a good feel will provide better control and impart confidence to the golfer. The Applicant has found that the feel of the putter is a function of the size of the sweet spot or hitting area, as well as the balance of the putter face which strikes the golf ball. Thus, it is the object of this invention to provide a putter head that will reduce the torque created when the putter head strikes the ball off the sweet spot of the face, to produce better feel and control.

Applicant provides for a putter head that is unique in a number of ways, resulting in an enhanced sweet spot yielding better control and feel.

First, there is a face having uniform thickness. Second, the unique design provides that the overall balance of the putter head—both static and dynamic—the zero torque line and the perfect sweet spot are all aligned with the geometric center of the putter face and head. That is, a point on the putter face or head where there is an equal amount of weight from a line or point drawn on the front of the putter face across the top and to the back of the putter head. Finally, Applicant provides a putter head having a suspended face plate—that is, a face plate attached to the head at only the heel and toe ends thereof.

SUMMARY OF THE INVENTION

Applicant has provided a unique putter wherein the feel is improved by utilizing a low torque/high moment of inertia design with equally-weighed, very high density masses at the heel and toe of the putter head and a face having a uniform thickness, wherein the putter head is bilaterally symmetrical and dynamically balanced at the axis of symmetry. Further, Applicant has provided for a suspended face plate in combination with the foregoing qualities to provide for better feel and for an audio feedback means to assist the golfer in determining the accuracy of his putt.

DETAILED DESCRIPTION OF THE PREFERRED EMBODIMENT

Figure 1:
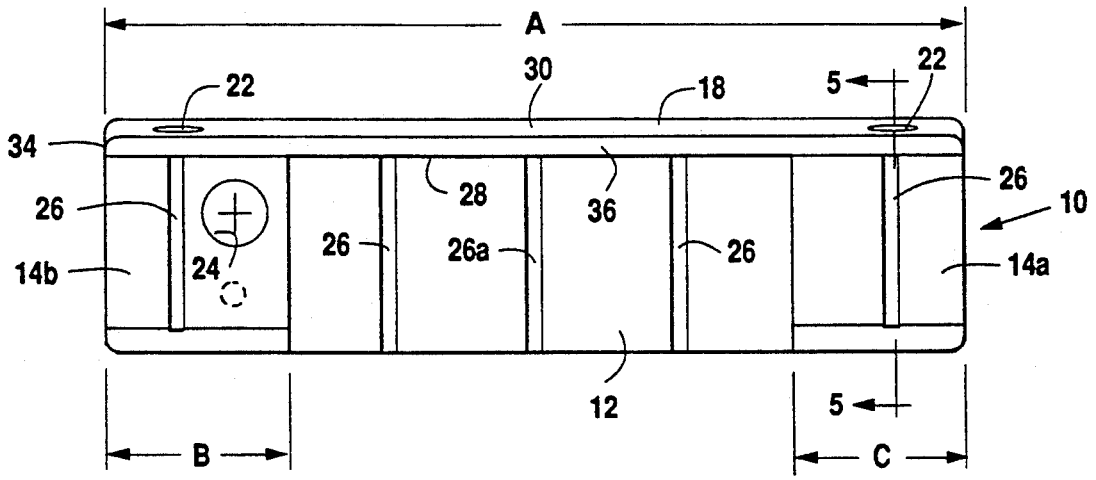
FIG. 1 is a top elevational view of the three-piece putter of applicant's present invention.
Figure 2:
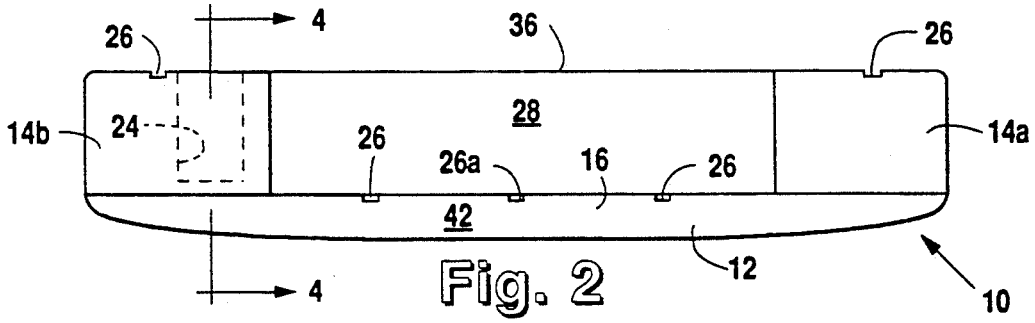
FIG. 2 is a rear elevational view of the three-piece putter head of applicant's present invention.

As a matter of background, three embodiments of applicant's invention are presented in detail below. All three embodiments, however, are characterized by applicant's novel combination of uniform face plate thickness and symmetry—both geometrical and balancewise.

The first embodiment is set forth in FIGS. 1–8, and provides for a three-piece putter head with face plate integral with a base. The second embodiment is set forth in FIGS. 1*a*–8*a* and provides for a four-piece putter head with a suspended face plate. The third embodiment is set forth in FIGS. 1*b*–8*b* and provides for a four-piece putter head with a suspended face plate.

FIGS. 1–8 illustrate a putter head (10) of applicant's present invention. More specifically, FIGS. 1–8 provide various views of three-piece putter head (10) comprising generally L-shaped bracket (12), a toe end block (14*a*) and a heel end block (14*b*). L-shaped bracket (12) is provided with a base (16) and a generally tabular face (18) of uniform thickness. Screws (20) are dimensioned for receipt through walls defining holes (22) of base (16) and face (18) to thread into toe end block (14*a*) and heel end block (14*b*) respectively to complete the assembly of putter head (10). Shaft bore (24) in heel end block (14*b*) is dimensioned for receipt of a shaft of a golf club (not shown).

Indicia (26) are provided for marking across the top surface of putter head (10). Indicia (26) provide assistance to the golfer in aligning his swing with a line between the ball and the cup to help hole the putt. Indicia (26*a*) represents a line about which putter head (10) is geometrically symmetrical and also represents the line which meets face (18) at the sweet spot, around which there is zero torque. Heel end block (14*b*) is 1-3/64" and toe end block (14*a*) is 1" long, shaft bore (24) compensating for the extra dimension of heel end block (14*b*). That is, toe end block (14*a*) and heel end block (14*b*) are similarly dimensioned, of the same weight or mass, made of material of the same high density, preferably bronze, and located an equal distance outboard from indicia (26*a*). The putter head (10) is generally bilaterally symmetrical about indicia (26*a*) except for shaft bore (24) compensations, which effects are minimal.

Turning now to the details of L-shaped bracket (12), it may be seen that face (18) is symmetrical about indicia (26*a*), is generally tabular in nature and has a uniform thickness from top to bottom and side to side. More specifically, L-shaped bracket (12) is comprised of planar rear surface (28) and planer front surface (30). Front surface (30) and rear surface (28) are parallel, thereby providing uniform thickness to face (18). Rear surface (28) and front surface (30) are joined by bottom edge (32), side edge (34), top edge (36) and side edge (38), the edges comprising the perimeter of face (18).

Turning now to the details of base (16) of L-shaped bracket (12), it is seen that base (16) is symmetrical about indicia (26*a*) and provided with a generally planar top surface (40), rear wall (42), side edges (44) and (46) and slightly radiused bottom surface (50). As set forth above, top surface (40) has indicia (26) inscribed thereon. Moreover, it is seen that base (16) of L-shaped bracket (12) has a front edge (48) which is integral with bottom edge (32) of face (18). As may be appreciated with references to FIGS. 3, 4 and 5, face (18) and base (16) join at an included angle which is slightly less than 90° . This provides loft to the face (18).

Figure 4:
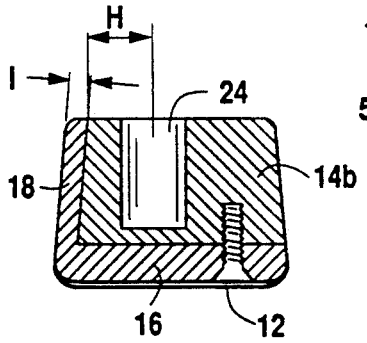
FIG. 4 is a heel cross-sectional elevational view of the three-piece putter head of applicant's present invention.
Figure 5:
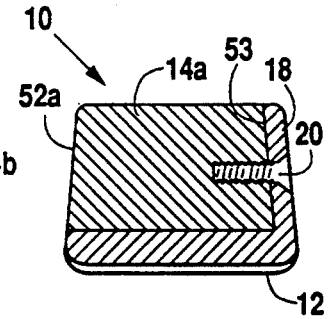
FIG. 5 is a cut-away toe elevational view of the three-piece putter head of applicant's present invention.
Figure 6:
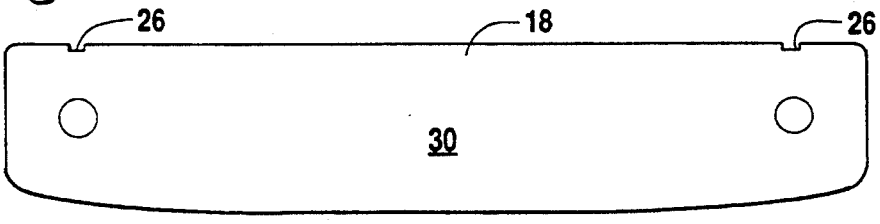
FIG. 6 is an front elevational view showing the face of the three-piece putter head of applicant's present invention.
Figure 1A:
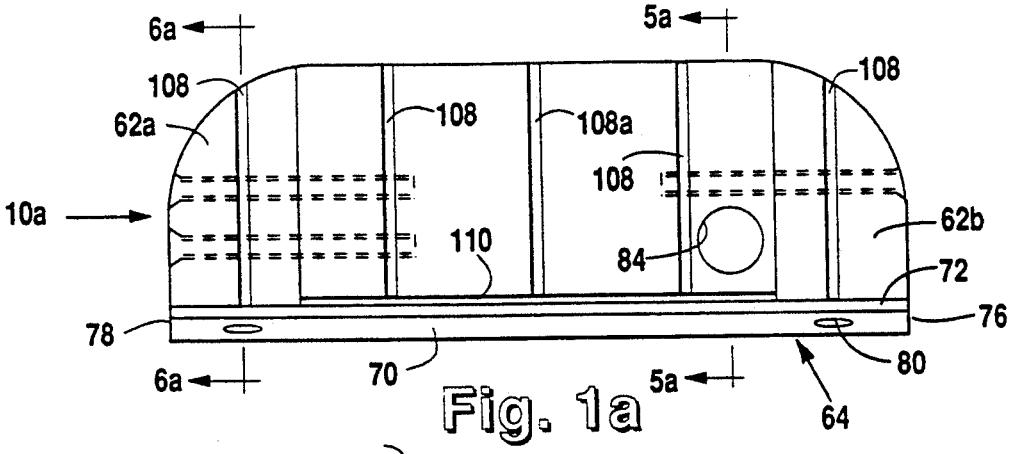
FIG. 1*a* is a top elevational view of the four-piece putter head of applicant's present invention.

The same angle of loft is carried over to rear surfaces (52*a*) of both toe end block (14*a*) and heel end block (14*b*) (See FIGS. 4 and 5). Turn now to the detailed of end blocks (14*a*) and (14*b*). More specifically, end blocks (14*a*) and (14*b*) are provided with planar side walls (52), a planer top surface (54) and a planar bottom surface (56). The included angle between bottom surface (56) of end blocks (14*a*) and (14*b*) and front surface (53) that abuts the back of the face (18) will be the same angle as the loft of face (18).

The preferred material for manufacturing end blocks (14*a*) and (14*b*) is bronze, but any high density metal could be used, preferably having a specific gravity of between 5 and 12. L-shaped bracket (12) is made of aluminum or another strong, light metal. Bronze has a high density and the location of end blocks (14*a*) and (14*b*) outboard the bilateral axis of symmetry as represented by indicia (26*a*) provides a high moment of inertia about the sweet spot and therefore less torque imparted by the stroke that strikes the golf ball off the sweet spot. The preferred dimensions A-L (as found in FIGS. 1, 3 and 4) are set forth in Table I below and provide for approximately 80% of the weight of putter head (10) to be located within one inch of the heel and toe ends.

TABLE I

Figure 3:
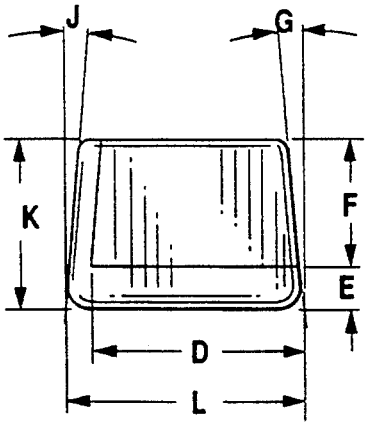
FIG. 3 is a side elevational view of the three-piece putter of applicant's present invention.

| LOCATION | | DESCRIPTION | PREFERRED DIMENSION | PREFERRED RANGE |
|---|---|---|---|---|
| FIG. 1 | A | Length of Putter Head | 5" | 3-⅝' to 6-¾" |
| FIG. 1 | B | Length of Heel End Block | 1-3/64" | ½" to 1-½" |
| FIG. 1 | C | Length of Toe End Block | 1" | ⅝" to 1-½" |
| FIG. 3 | D | Width of Top Surface of Base | 1-¼" | ¾" to 1-½" |
| FIG. 3 | E | Thickness of Base | ¼" | ⅛" to ½" |
| FIG. 3 | F | Inside Height of Face | 23/32" | ½" to 1-¼" |
| FIG. 3 | G | Trailing Loft of Heel and Toe Blocks | 5° | 0°to +10° |
| FIG. 4 | H | Distance Between Top Edge of Face and Center of Shaft Bore | ⅜" | ⅛" to ½" |
| FIG. 4 | I | Thickness of Face | 7/64" | 3/32" to ½" |
| FIG. 3 | J | Loft of Face | 5° | 0° to +10° |
| FIG. 3 | K | Height of Face | 31/32" | ⅝" to 1-½" |
| FIG. 3 | L | Width of Club Base, including Face | 1-23/64" | ⅞" to 1-½" |

Turning now to FIGS. 1*a*–8*a*, it is seen that putter head (10*a*) is comprised of four major pieces. That is, four-piece putter head (10*a*) is comprised of frame (60), toe end block (62*a*), heel end block (62*b*) and face (64). Like the three-piece head, the four pieces are held together by screws (66) to form a single piece unit. Face (64) is generally tubular in nature (see FIG. 2*a*) and has rear surface (68) and front surface (70), the surfaces joined by a perimeter including radiused bottom surface (72), straight sides (76) and (78) and straight top edge (74). One of the novelties of the present invention is that four-piece putter (10*a*) has, as with three-piece putter (10), a uniform thickness to face (64).

Figure 7:
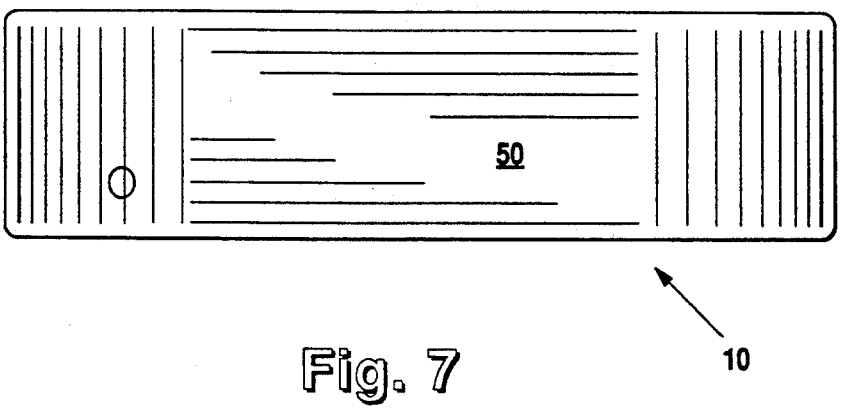
FIG. 7 is a bottom elevational view of the three-piece putter head of applicant's present invention.
Figure 7A:
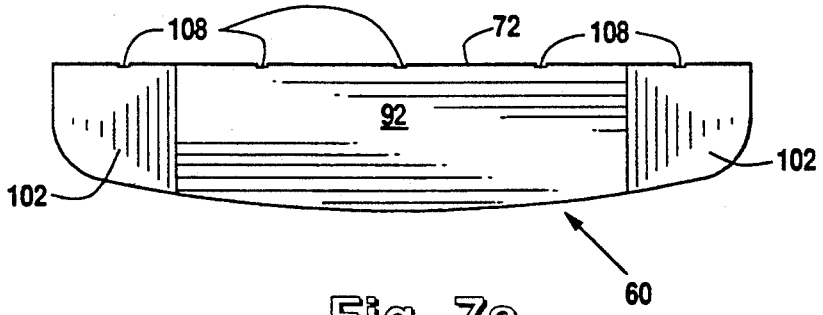
FIG. 7*a* is a rear elevational view of the four-piece putter head of applicant's present invention.

Turning now to frame (60), it is seen that the general shape of frame (60) is rectangular having a generally flat top surface (82) with a shaft bore (84) in the aluminum frame therein for connecting putter head (10*a*) to a shaft of a golf club. Side walls (86), front wall (88), rear surface (92) (FIG. 7*a*) all being generally flat, and contoured bottom surface (90) complete the general rectangular shape of frame (60).

Figure 8A:
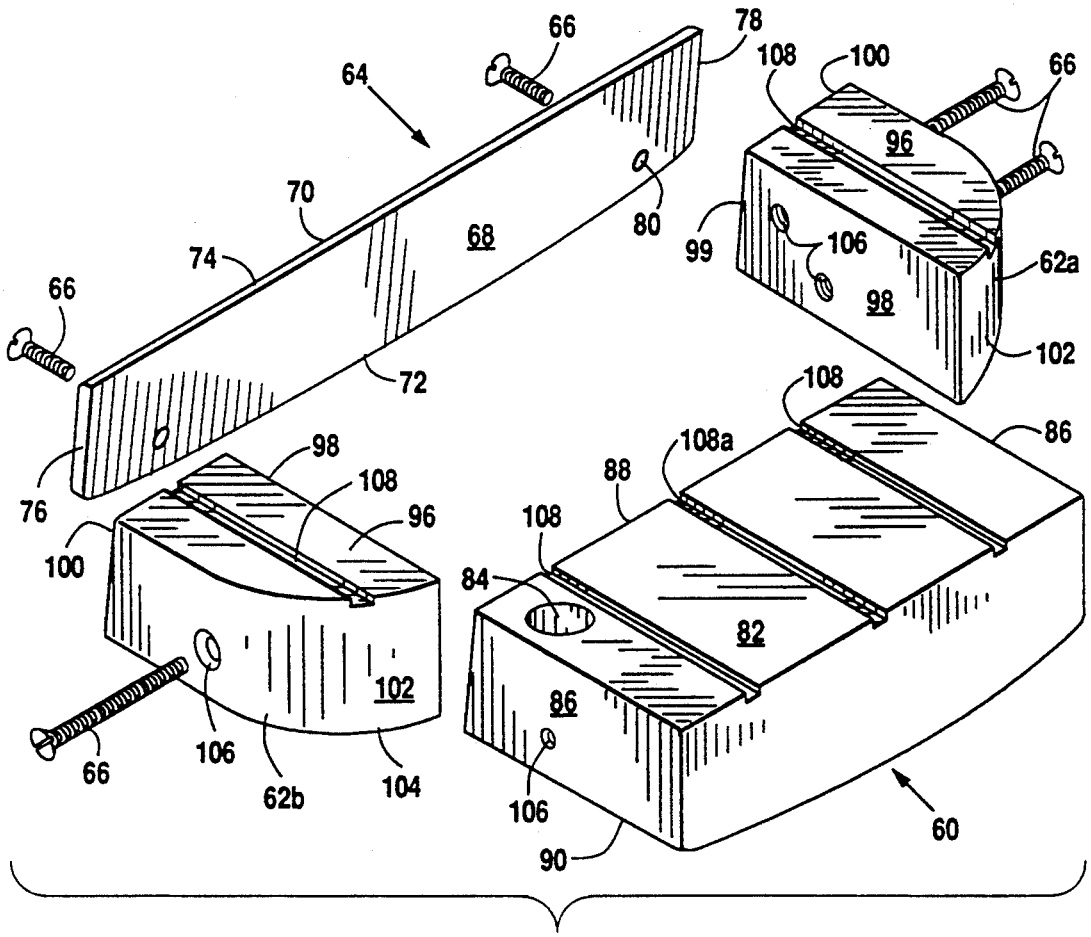
FIG. 8*a* is an exploded perspective view of the four-piece putter head of applicant's present invention.
Figure 7B:
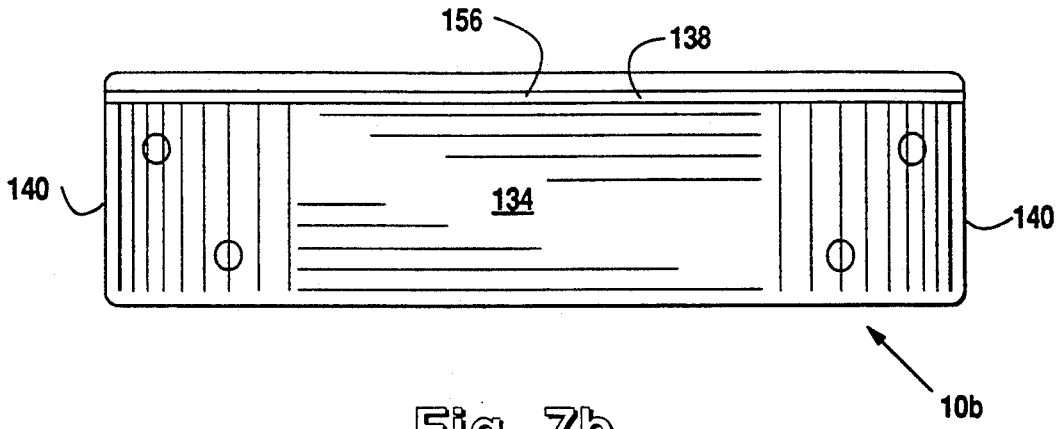
FIG. 7*b* is a bottom elevational view of the four-piece putter head of applicant's present invention, having a suspended face plate.

End blocks (62*a*) and (62*b*) are similarly dimensioned and of the same weight or mass, having top surface (96) which is generally flat, an inner side wall (98) and a front wall (100). The edge between front wall (100) and inner side wall (98) is front edge (99) as seen in FIG. 8*a*. Planar top surface (96), generally flat bottom surface (104) and curved outer walls (102) complete end blocks (62*a*) and (62*b*). Toe end block (62*a*) has two threaded bores (106) for receipt of screws (66) therein. Heel end block (62*b*) has one threaded bore (106). These threaded bores extend into side walls (86) of frame to affix end blocks (62*a*) and (62*b*) in fixed spaced relation about frame (60).

Indicia (108) are inscribed on top surfaces (82) and (96) in a manner similar to those set forth with three-piece putter head (10) above. That is, indicia (108) includes indicia (108*a*) which is a line representing the geometric center (108*a*) of putter head (10*a*). The sweet spot of putter head (10*a*) lies on face (64) adjacent and online corresponding with an extension of (108*a*) across face (64), again, assisting the golfer in lining up the putt. Moreover, like three-piece putter head (10), four piece putter head (10*a*) is generally bilaterally symmetrical about a plane vertically through indicia (108*a*). This provides a sweet spot about which there is zero torque and a high moment of inertia, end blocks (62*a*) and (62*b*) being made of bronze or similarly dense material. Frame (60) and face (64) are preferably made of aluminum. Face (64) is mounted to end blocks (62*a*) and (62*b*) such that there is a loft of preferably 5° and generally between 0° and +10°.

Figure 2A:
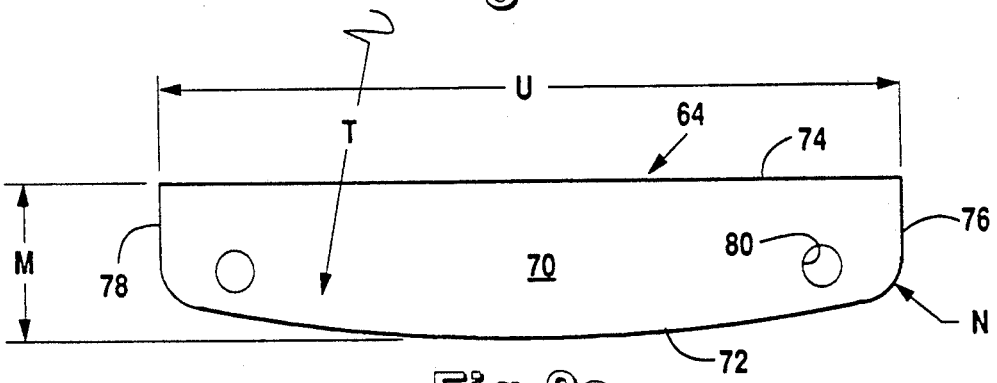
FIG. 2*a* is a front elevational view of the four-piece putter head of applicant's present invention.

The embodiment set forth in FIGS. 1*a*–8*a* provides an additional novelty not found in the three-piece head above. That is, when end blocks (62*a*) and (62*b*) are affixed to frame (60), front edges (99) of the end blocks are set forward of front wall (88) of the frame to provide a space (110) between rear surface (68) of face (64) and front wall (88) of frame (60). This space is uniform side-to-side and up and down and provides better control and feel to the putter and enhances the feel and control when striking the golf ball. Moreover, it provides for a putter head with a suspended face—that is, a face attached to the putter head at only the removed ends thereof. As seen in FIGS. 2*a* and 8*a*, face (64) has holes (80) at the heel and toe ends thereof, for which to attach to end blocks (62*a*) and (62*b*).

Preferred dimensions are set forth in Table II below, and when four piece putter head (10*a*) is constructed according to these teachings. Seventy percent (70%) of the weight of the head is within three-quarter inch (¾") of the heel and toe ends. The end blocks are preferably bronze but any high density metal with a specific gravity of between five and 12 may be used.

TABLE II

Figure 3A:
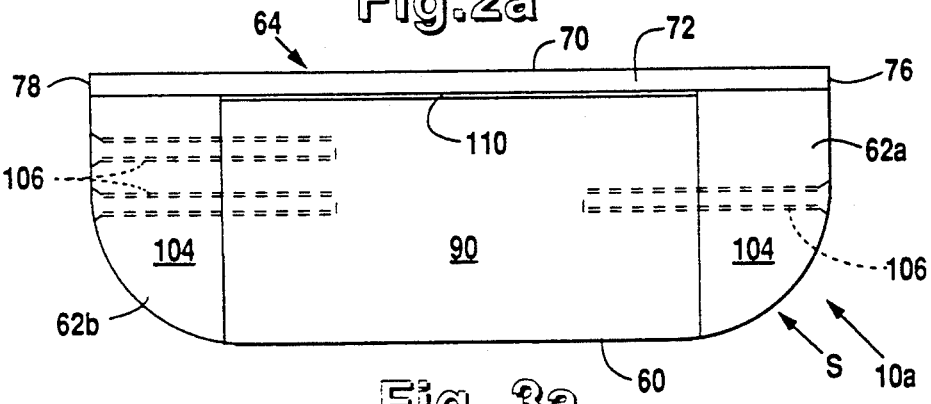
FIG. 3*a* is a bottom elevational view of the four-piece putter head of applicant's present invention.
Figure 4A:
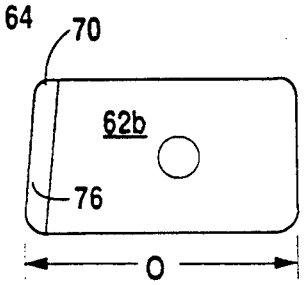
FIG. 4*a* is a side elevational view of the heel of applicant's four-piece putter head.
Figure 5A:
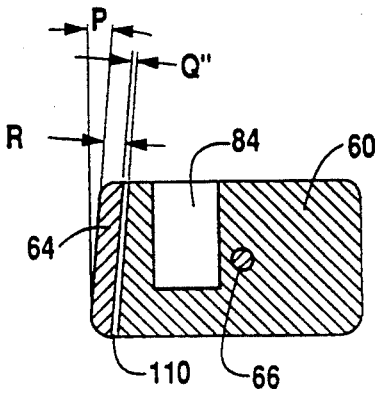
FIG. 5*a* is a cutaway cross-section side elevational view of the heel of the four-piece putter head of applicant's present invention.
Figure 6A:
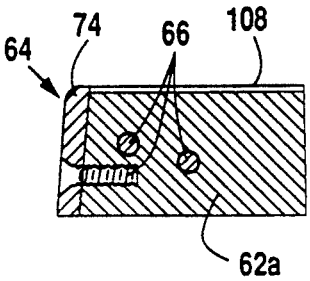
FIG. 6*a* is a side elevational cutaway view of the toe of the four-piece putter head of applicant's present invention.

| LOCATION | | DESCRIPTION | PREFERRED DIMENSION | PREFERRED RANGE |
|---|---|---|---|---|
| FIG. 2a | M | Height of Face | ⅞" | ⅝" to 1-½" |
| FIG. 2a | N | Radius of Curvature of Lower Corners of Face | ¼" | ⅛" to ½" |
| FIG. 4a | O | Width of Bottom of Putter Head, including Face | 1-35/64" | 1" to 2-½" |
| FIG. 5a | P | Loft of Face | 5° | 0° to +10° |
| FIG. 5a | Q | Width of Space Between Face and Frame | 3/64" | 1/32" to ¼" |
| FIG. 5a | R | Thickness of Face | 7/64" | 1/32" to ¼" |
| FIG. 3a | S | Radius of Curvature of Heel and Toe End Blocks | ⅞" | ⅜" to 1" |
| FIG. 2a | T | Length of Face | 4-¼" | 3-⅝" to 5-¾" |
| FIG. 2a | U | Radius of Curvature of Bottom Edge of Face | 10" | 6" to 12" |

Here again, as with the other embodiments, slight differences in size exist between the heel and toe end blocks to account for the shaft bore, yet keep the weights or masses the same.

Figure 8B:
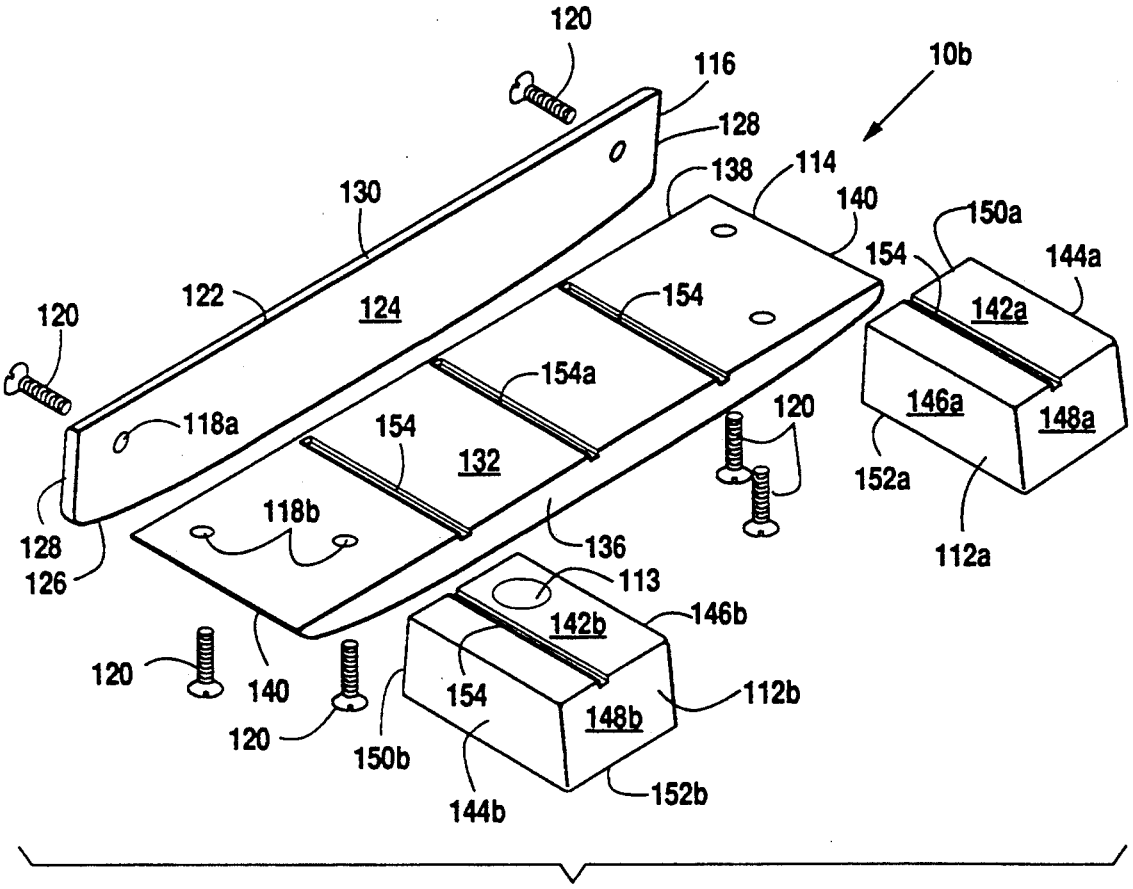
FIG. 8*b* is an exploded perspective view of the four-piece putter head of applicant's present invention, having a suspended face plate.

FIGS. 1*b* through 8*b* illustrate a four-piece, suspended face putter head of applicant's present invention (10*b*). As seen in FIG. 8*b*, putter head (10*b*) is constructed of four main components: toe end block (112*a*), heel end block (112*b*), with shaft bore (113) in the top surface thereof, base (114) and face (116). Screw holes (118*a*) (in face) and (118*b*) (in base) are provided as are screws (120) to hold the four pieces together as illustrated.

Figure 6B:
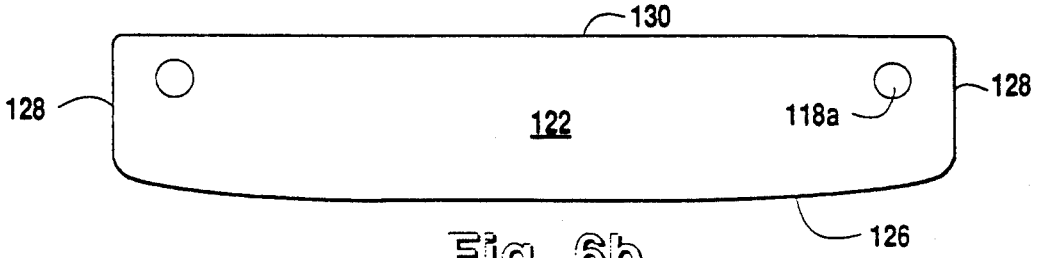
FIG. 6*b* is a front elevational view of the four-piece putter head of applicant's present invention, having a suspended face plate.
Figure 8:
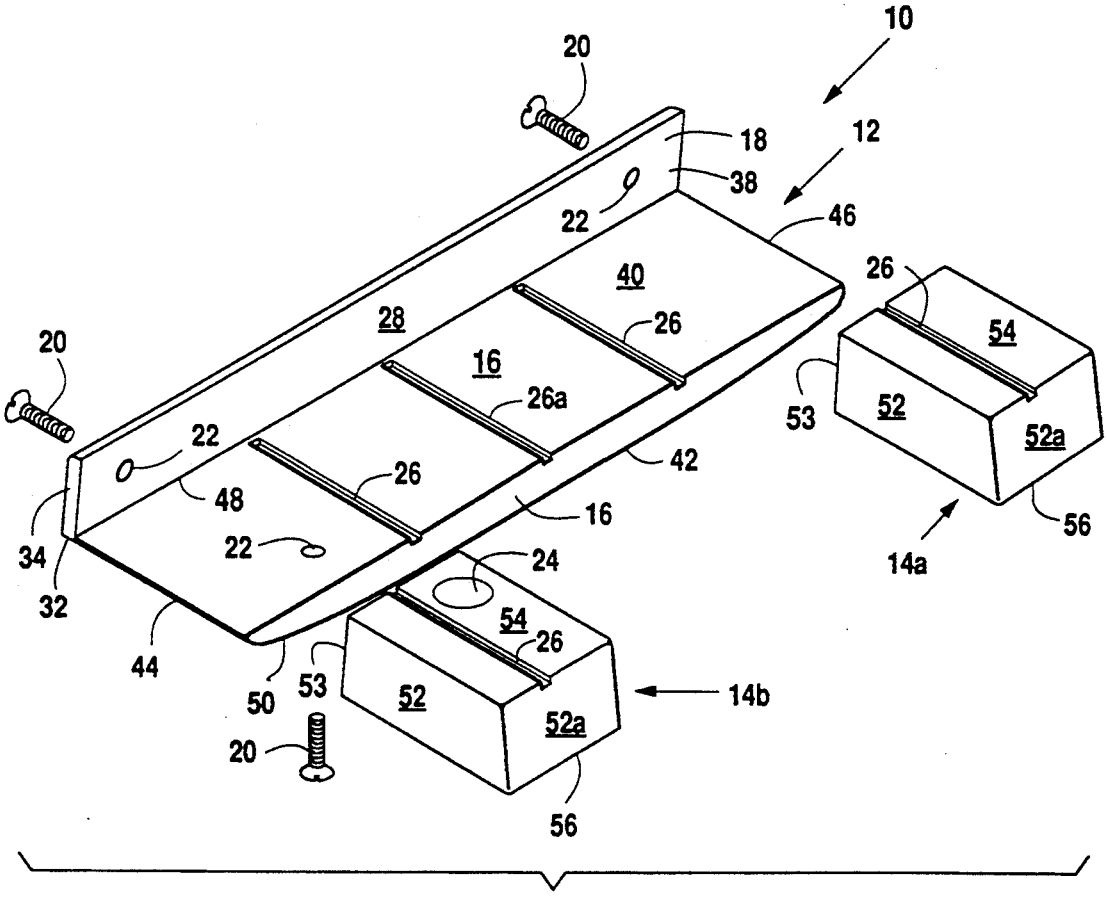
FIG. 8 is an exploded perspective view of the three-piece putter head of applicant's present invention.

Turning now to face (116), it is seen that it has a front surface (122) and a rear surface (124), both being planar and parallel, thus providing a uniform thickness thereto. A perimeter of face (116) is comprised of bottom edge (126), side edges (128), top edge (130), meeting to form an outline for face (116) which may be best appreciated in FIG. 6*b*.

Figure 2B:
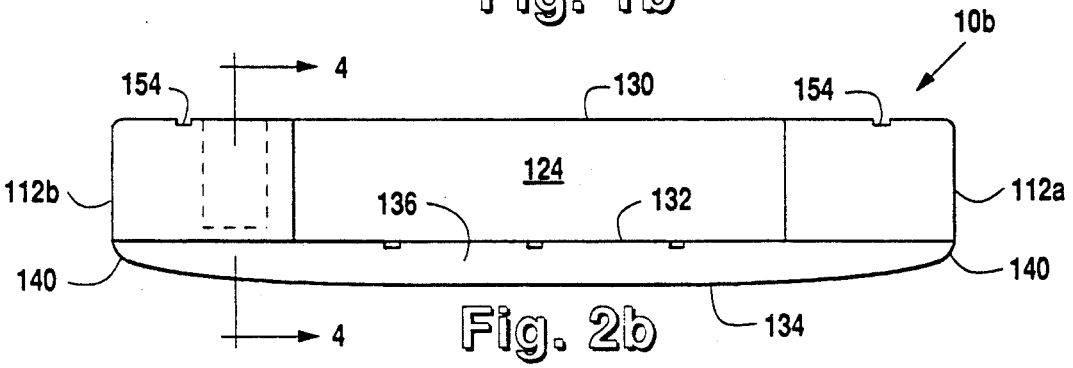
FIG. 2*b* is a rear view of the four-piece putter head of applicant's present invention, having a suspended face plate.

Turning now to the details of base (114), it is seen that it is comprised of top surface (132) which is generally planar, and a curved bottom surface (134), rear wall (136) and front wall (138). Side edges (140) complete the structure of base (114). As can be appreciated in FIG. 8*b*, top surface (132) is generally flat, and bottom surface (134) is curved near side edges (140), as best appreciated in FIG. 2*b*.

Turning now to the details of end blocks (112*a*) and (112*b*), they are seen to be comprised of generally rectangular prisms having top surfaces (142*a*) and (142*b*) which are generally flat, outer walls (144*a*) and (144*b*), inner walls (146*a*) and (146*b*), rear walls (148*a*) and (148*b*), front walls (150*a*) and (150*b*), and top surfaces (142*a*) and (142*b*). As with the previous embodiments, face (116) is constructed such that it is provided with a loft in the general range as set forth in Table III below. That is, both toe end block (112*a*) and heel end block (112*b*) have front walls (150*a*) and (150*b*) typically describing an angle of slightly less than 90° with bottom surfaces (152*a*) and (152*b*), respectively, to provide the loft to face (116). Likewise, trailing loft is provided wherein rear wall surfaces (148*a*) and (148*b*) inscribe an angle of slightly less than 90° with bottom surfaces (152*a*) and (152*b*), respectively. The face and trailing edge loft can be appreciated with reference to dimensions X and Y in FIG. 3*b*.

Space (156) is provided by attaching end blocks (112*a*) and (112*b*) to top surface (132) of base (114) such that front surfaces (150*a*) and (150*b*) are aligned such that they project forward of front wall (138) of base (114). Space (156) provides for a suspended face giving putter head (10*b*) more control and the golfer better feel for the stroke. Embodiment (10*b*) of four-piece putter head provides the high moment of inertia of the earlier described four-piece putter with the feel of face (116) having uniform thickness and space (156). In addition, both embodiments having suspended faces—that is, faces attached to the body of the putter head only at the removed ends thereof, produce a distinctive "click" when striking a golf ball on the sweet spot. A sound of a different pitch is produced when the ball strikes off the sweet spot—thus producing audible feedback to the golfer. Note, however, that the embodiment set forth in FIGS. 1*b*–8*b* discloses a space gap or space (156) which runs the full length—preferably 5"—of the face plate along the bottom while the gap or space runs only between inner walls (146*a*) and (146*b*) at the top. On the suspended face featured in FIGS. 1*a*–8*a*, the gap or space (110) is uniform along the top and bottom and runs only between front edges (99) of end blocks (62*a*) and 62*b*). This does not provide as loud a "click" as the full-length suspended face.

As with the previous embodiments, end blocks (112*a*) and (112*b*) are of the same weight as mass and are preferably comprised of bronze or brass or a similar metal having high density. Base (114) of face (116) are preferably comprised of aluminum or other alloy being both strong and light.

The preferred dimensions are set forth in Table III below.

TABLE III

Figure 1B:
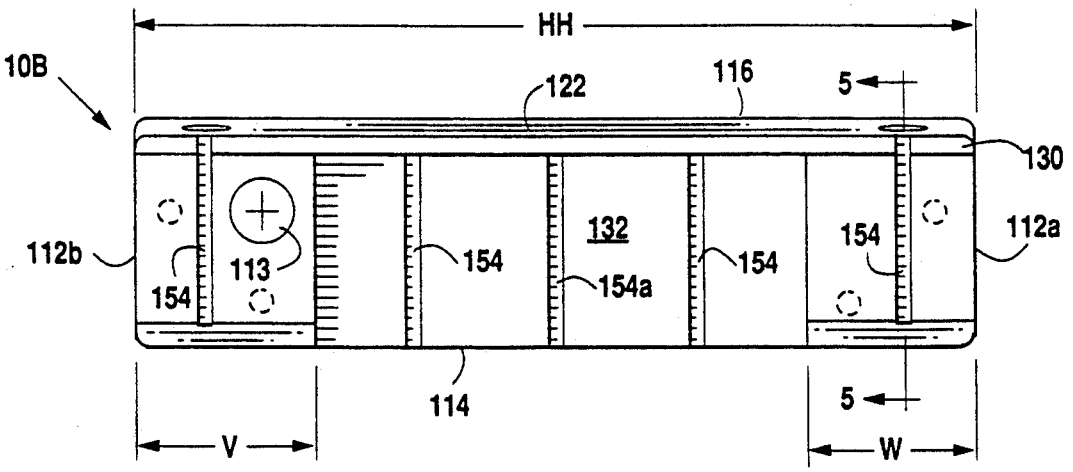
FIG. 1*b* is a top elevational view of the four-piece putter head of applicant's present invention, having a suspended face plate.
Figure 3B:
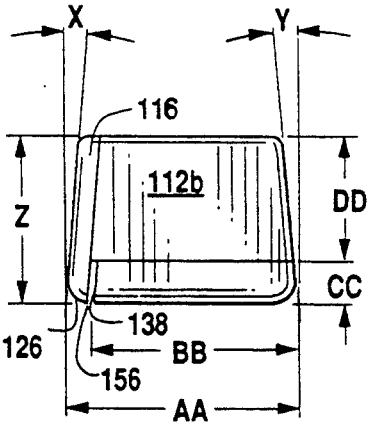
FIG. 3*b* is an end elevational view of the heel of the four-piece putter head of applicant's present invention, having a suspended face plate.
Figure 4B:
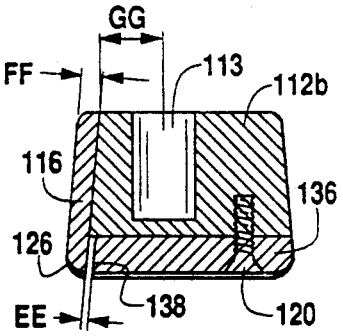
FIG. 4*b* is a side elevational cutaway view of the heel of applicant's four-piece putter head, having a suspended face plate.
Figure 5B:
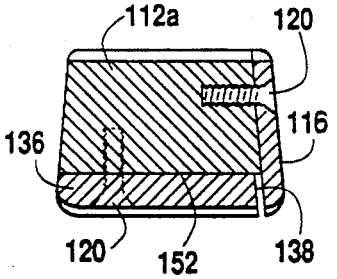
FIG. 5*b* is a cutaway toe elevational view of the four-piece putter head of applicant's present invention, having a suspended face plate.

| LOCATION | | DESCRIPTION | PREFERRED DIMENSION | PREFERRED RANGE |
|---|---|---|---|---|
| FIG. 1b | V | Length of Heel End Block | 1-3/64" | ½" to 1-½" |
| FIG. 1b | W | Length of Toe End Block | 1" | ⅝" to 1-½" |
| FIG. 3b | X | Loft of Face | 5° | 0° to +10° |
| FIG. 3b | Y | Trailing Loft of Heel and Toe Blocks | 5° | 0° to +10° |
| FIG. 3b | Z | Height of Face | 31/32" | ⅝" to 1-½" |
| FIG. 3b | AA | Width of Club Base, Including Face | 1-23/64" | ⅞" to 1-½" |
| FIG. 3b | BB | Width of Top Surface Frame | 1-¼" | ¾" to 1-½" |
| FIG. 3b | CC | Thickness of Frame | ¼" | ⅛" to ½" |
| FIG. 3b | DD | Inside Height of Face | 31/32" | ⅞" to 1-½" |
| FIG. 4b | EE | Width of Space Between Face and Frame | 3/64" | 1/32" to ¼" |
| FIG. 4b | FF | Thickness of Face | 7/64" | 1/32" to ¼" |
| FIG. 4b | GG | Distance Between Top Edge of Face and Center of Shaft Bore | ⅜" | ⅛" to ½" |
| FIG. 1b | HH | Length of Face | 5" | 3-⅝" to 6-¾" |

Indicia (154) includes (154*a*) which marks the geometric center. Functionally, indicia (154) and (154*a*) serve the same purpose as those set forth in previous embodiments.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position or manner in which the invention may be constructed or used.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. A putter head for use with a golf club having a shaft, said putter head having a heel end and a toe end comprising:

a heel weight and a toe weight, said heel weight and said toe weight being of the same composition, similarly shaped and having substantially the same mass;

a frame for maintaining fixed, spatial relation between said heel weight and said toe weight, said frame including an opening for securing said shaft to said putter head;

a face plate having uniform thickness, said face being generally tabular and having a front surface and a rear surface, the front surface and rear surface separated by a perimeter comprising a top edge and a bottom edge and two side edges, said face plate abuttingly attached by a first means for attachment to a first surface of said heel weight and by a second means for attachment to a first surface of said toe weight to form a uniform gap between said frame and said face plate along the entire height of said face plate from said top edge to said bottom edge between said heel weight and said toe weight;

wherein said heel weight, said toe weight, said frame and said face are assembled into a unitary structure defining said putter head wherein 70% of the total weight of said putter head is located within three-quarter inch of said heel end and said toe end.

2. The putter head as described in claim 1 further including means for mounting said face to said heel weight and said toe weight, said mounting means comprising walls defining a threaded bore in each of said heel weight and said toe weight, and holes in said face and screws dimensioned for receipt through the holes of said face and into the bores of said heel weight and toe weight.

3. The putter head of claim 1 wherein each of said heel and toe weights has a sloped surface for abutment with said rear surface of said face to provide a loft on said face of 5°.

4. The putter head of claim 1 wherein said frame includes indicia marked on a surface thereof, the indicia to assist the golfer in lining up a putt.

5. The putter head of claim 1 wherein said heel weight and said toe weight are generally block shaped and are located laterally equidistant from a plane dividing said frame symmetrically.

6. The putter head of claim 5 wherein said heel weight and said toe weight are composed of bronze and said frame and said face are composed of aluminum.

7. The putter head of claim 1 further comprising means to detachably mount said toe weight and said heel weight to said face.

8. A putter head for a golf club having a shaft, said putter head having a heel end and a toe end comprising:

a frame, said frame having a planar front face, a bottom face, a planar top face, a planar rear face and two planar side faces;

two identically composed, similarly dimensioned and weighted separate end blocks, dimensioned to lay against said planar top face of said frame with a front portion of each of said separate end blocks extending beyond said front face of said frame; and a front plate having uniform thickness, said front plate abuttingly mounted to said end blocks such that a space is defined extending between said front plate and the front face of said frame along an entire bottom length of said front plate and further such that approximately 80% of the total weight of said putter head is located within one inch of said heel end and said toe end of said putter head.

9. The putter head as described in claim 13 wherein said front plate has a loft of 5°.

10. A putter head for a golf club having a shaft, said putter head having a heel end and a toe end comprising:

a one piece, L-shaped bracket having a face plate portion of uniform thickness and a base member portion, said face plate portion and said base member portion being generally tabular and disposed one to the other, integrally joined along adjacent edges thereof at an included angle of between 80° and 95°, said L-shaped bracket being generally bilaterally symmetrical;

two identically composed, similarly dimensioned and weighted separate end blocks;

means to mount said end blocks on removed ends of said bracket; and means to mount the shaft to said one of said end blocks;

wherein said end blocks are abuttingly mounted with faces thereof substantially flush with a rear surface of said face plate portion and a top surface of said base member portion of said L-shaped bracket and wherein approximately 80% of the total weight of said putter head is located within one inch of said heel end and said toe ends of said putter head.

11. The putter head of claim 10 wherein said end blocks are comprised of a metal having a specific gravity greater than 5 and wherein said L-shaped bracket is comprised of aluminum.

12. The putter head of claim 11 wherein said L-shaped bracket further comprises indicia on the surface thereof, said indicia for assisting the golfer in aligning his swing with a line between the golf ball and the golf cup.

13. The putter head as described in claim 12 wherein the face is between 7/64" and ⅛" thick.

14. A putter head for a golf club having a shaft, said putter head having a heel end and a toe end comprising:

a heel end block and a toe end block of identical bronze composition, said end blocks being similarly dimensioned to provide a 5° loft to said putter head and having generally flat surfaces, said heel end block having shaft attachment means integral therewith;

a base plate having a flat upper surface;

a face plate having a flat front surface and a flat rear surface, said front and rear surfaces being joined by a perimeter and having uniform thickness;

means for attaching said end blocks to said base plate at removed ends thereof whereon 70%–80% of the total weight of said putter head is located within three-quarter inch to one inch of said heel end and said toe end; and means for abuttingly attaching said rear surface of said face plate to said end blocks.

15. The putter head of claim 14 further comprising indicia means for assisting the golfer in aligning the ball.

16. The putter head of claim 14 wherein said gap defining said spaced-apart relation between said face plate and said base plate is between 1/32" and ¼".

* * * * *